US005648700A

United States Patent [19]

Chu et al.

[11] Patent Number: 5,648,700

[45] Date of Patent: Jul. 15, 1997

[54] FLUORESCENT LAMP DEVICE

[76] Inventors: Michael Yi Chu, 7F, No. 249, Sec. 1, Ta-An Rd.; David Yu Chu, 5F, No. 17, Alley 4, Lane 217, sec. 3, Chung-Hsiao E. Rd., both of Taipei City, Taiwan

[21] Appl. No.: 514,608

[22] Filed: Aug. 14, 1995

[51] Int. Cl.[6] ..... H01J 1/62; H01J 63/04; H01J 17/04; H01J 61/04

[52] U.S. Cl. ..... 313/493; 313/491; 313/633; 313/634

[58] Field of Search ..... 313/493, 572, 313/573, 577, 634, 113; 362/255, 256, 485

[56] References Cited

U.S. PATENT DOCUMENTS 2,518,248 8/1950 Ohlund ..... 313/493

3,778,662 12/1973 Johnson ..... 313/573

4,099,090 7/1978 Corth ..... 313/493

*Primary Examiner*—Sandra L. O'Shea

*Assistant Examiner*—Mack Haynes

*Attorney, Agent, or Firm*—Lockwood, Alex, FitzGibbon & Cummings

[57] ABSTRACT

A fluorescent lamp device includes a transparent sealed container which is filled with a working gas, an electron emitting unit which extends into the container and which is operable to emit electrons that interact with the working gas to generate short-wave ultraviolet energy, and a light emitting member which is disposed in the container and which is made of an insulator material. The light emitting member has an external surface coated with a layer of fluorescent material that converts the ultraviolet energy into visible light.

2 Claims, 3 Drawing Sheets

FLUORESCENT LAMP DEVICE

BACKGROUND OF THE INVENTION

1. Field of the Invention

This invention relates to a fluorescent lamp device, more particularly to a fluorescent lamp device which provides a stronger light output per unit area.

2. Description of the Related Art

Referring to FIG. 1, a conventional fluorescent lamp device is shown to comprise a transparent sealed glass tube 11. The glass tube 11 has an inner peripheral surface coated with a layer of fluorescent material 12, such as a fluorescent metal salt or a phosphorescent metal salt, and is filled with a low pressure working gas 13 that contains mercury vapor. A pair of electrodes 14, 15 are installed respectively at two opposed ends of the glass tube 11 and are connected to a ballast 16 which provides a starting voltage and which limits current flow and to a starter 17 which is used to heat the electrodes 14, 15.

When the lamp device is energized, a low-current glow discharge forms in the starter 17. The heat from this glow is sufficient to form a short circuit through the starter 17. The full output voltage of the ballast 16 then causes current to flow through the electrodes 14, 15, thereby heating and causing the electrodes 14, 15 to emit electrons. At this time, the starter 17 is open circuit and cools. The electrons interact with the mercury atoms of the working gas 13 so as to generate short-wave ultraviolet energy. The fluorescent material 12 on the inner peripheral surface of the glass tube 11 converts the short-wave ultraviolet energy into visible light. However, the intensity of the visible light emitted out of the glass tube 11 is reduced due to the shielding effect of the fluorescent material 12 on the glass tube 11. To increase the intensity of the visible light, the length of the glass tube 11 must be increased so as to increase the amount of the fluorescent material 12. However, increasing the length of the glass tube 11 results in occupying space and in inconvenience of assembly. In addition, it is noted that a conventional fluorescent lamp .device is usually provided on a ceiling such that the upwardly projecting visible light is useless. Although the provision of a reflector on the conventional fluorescent lamp device for reflecting the upwardly projecting visible light has been proposed, the reflector is distant from the glass tube so that the efficiency of the reflector is reduced.

SUMMARY OF THE INVENTION

Therefore, the main objective of the present invention is to provide a fluorescent lamp device which provides a stronger light output per unit area.

According to the present invention, a fluorescent lamp device includes a transparent sealed container which is filled with a working gas, an electron emitting unit which extends into the container and which is operable to emit electrons that interact with the working gas to generate short-wave ultraviolet energy, and a light emitting member which is disposed in the container and which is made of an insulator material. The light emitting member has an external surface coated with a layer of fluorescent material that converts the ultraviolet energy into visible light.

BRIEF DESCRIPTION OF THE DRAWINGS

Other features and advantages of the present invention will become apparent in the following detailed description of the preferred embodiments, with reference to the accompanying drawings, of which.

DETAILED DESCRIPTION OF THE PREFERRED EMBODIMENT

Figure 1:
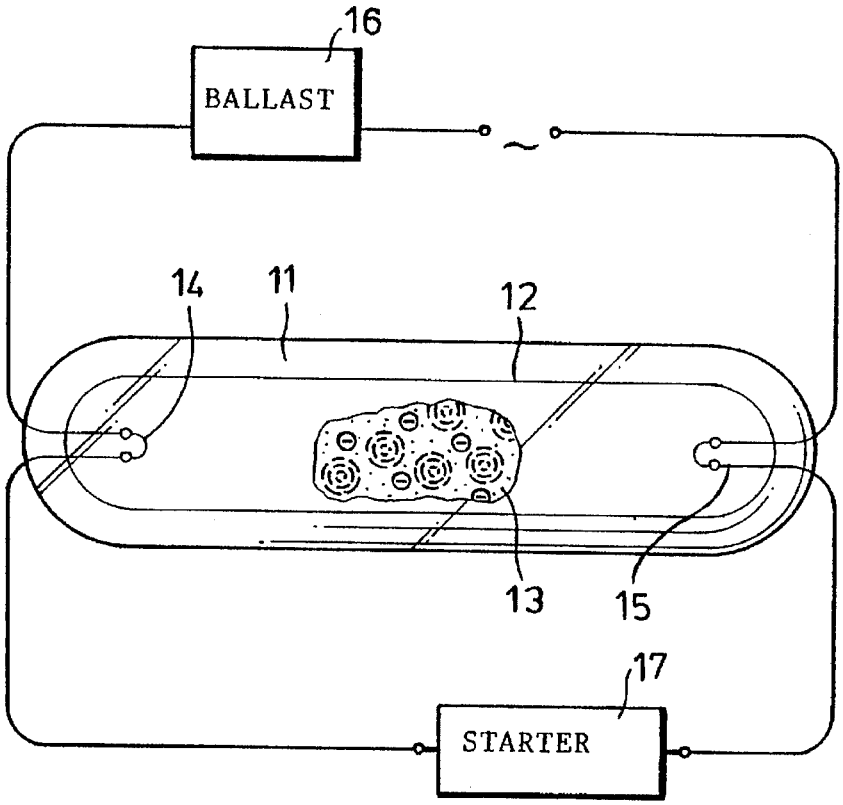
FIG.1 PRIOR ART
FIG. 1 is a schematic perspective view of a conventional fluorescent lamp device.
Figure 2:
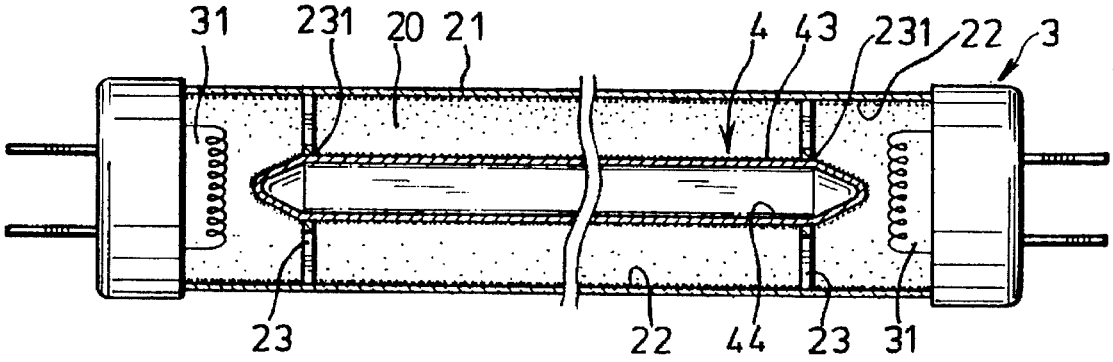
FIG. 2 is a partly sectional view of a fluorescent lamp device according to a first embodiment of the present invention.

Referring to FIG. 2, a fluorescent lamp device according to the first embodiment of the present invention includes a transparent sealed container 21, electron emitting means 3 and a light emitting member 4.

The container 21 is an elongated cylindrical tube having two opposed ends and is filled with a working gas 20 which includes mercury vapor. The container 21 has an inner peripheral surface coated with a layer of fluorescent material 22, such as a fluorescent metal salt or a phosphorescent metal salt. A retaining means is disposed in the container 21 between the two opposed ends and includes a pair of spaced perforated support members 23 which are made of an insulator material. Each of the support members 23 is formed with a central hole 231.

The electron emitting means 3 includes a pair of electrodes 31 which extend into the container 21 and which are installed respectively at the two opposed ends of the container 21. The electron emitting means 3 further includes a ballast (not shown) and a starter (not shown). Since the operations of the ballast and the starter are similar to those mentioned beforehand, detailed descriptions thereof are thus omitted herein.

The light emitting member 4 is made of an insulator material and is disposed in the container 21 between the electrodes 31 of the electron emitting means 3. The light emitting member 4 is an elongated member having two opposed end portions and is retained in the container 21 by extending of the opposed end portions thereof respectively through the central holes 231 of the support members 23. In the present embodiment, the elongated member is a sealed tube with two closed ends. The tube is transparent and has an inner peripheral surface coated with a layer of reflective material 44, such as mercury. The light emitting member 4 has an external surface coated with a layer of fluorescent material 43.

In operation, the electron emitting means 4 is operable to emit electrons (not shown) which interact with the working gas 20 to generate short-wave ultraviolet energy. The fluorescent material 22 on the inner peripheral surface of the container 21 and the fluorescent material 43 on the external surface of the light emitting member 4 convert the ultraviolet energy into visible light. Since the amount of the fluorescent material is increased, the intensity of the visible light is thus increased. Moreover, the visible light emitted toward the light emitting member 4 is reflected by the reflective material 44 such that all of the visible light can be emitted out of the container 21. Thus, the strength of the light output is much greater as compared with the conventional fluorescent lamp device.

Figure 3:
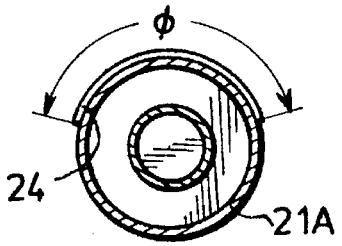
FIG. 3 is a sectional view of a fluorescent lamp device according to a second embodiment of the present invention.

Referring to FIG. 3, a second embodiment of the present invention is shown. In the present embodiment, the container (21A) has an outer peripheral surface with a longitudinally extending section that is coated with a layer of reflective material 24. The section has a predetermined angular width ø, such as 90°, 120°, 180°. Since the reflective material 24 is provided directly on the container (21A), the efficiency thereof is higher than that of the reflector used in the conventional fluorescent lamp device mentioned beforehand.

Figure 4:
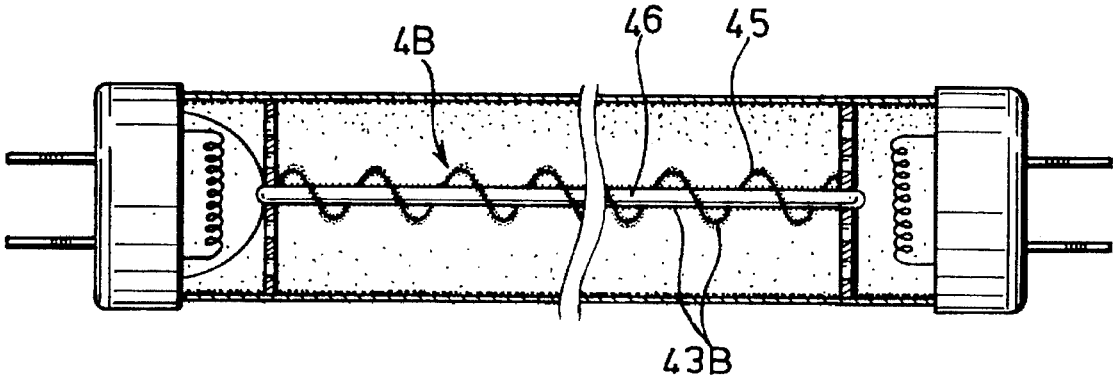
FIG. 4 is a partly sectional view of a fluorescent lamp device according to a third embodiment of the present invention.

Referring now to FIG. 4, a third embodiment of the present invention is shown. In this embodiment, the light emitting member (4B) is a rod 46 having a plurality of insulator threads 45 wound thereon. The rod 46 and the insulator threads 45 are coated with a layer of fluorescent material (43B). Since the amount of fluorescent material (43B) on the light emitting member (4B) of the present embodiment is larger than that of fluorescent material 43 on the light emitting member 4 of the first embodiment, the intensity of visible light per unit area is greater as compared with that of the first embodiment.

Figure 5:
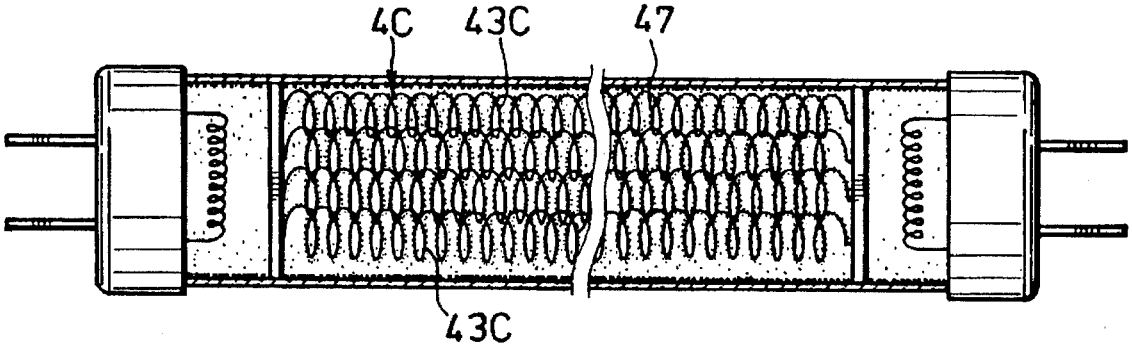
FIG. 5 is a partly sectional view of a fluorescent lamp device according to a fourth embodiment of the present invention.

Referring now to FIG. 5, a fourth embodiment of the present invention is shown. In this embodiment, the light emitting member (4C) includes a plurality of coiled insulator threads 47, such as glass fibers or the like, that are coated with a layer of fluorescent material (43C). Perforated members, such as net-like members, are disposed in the container and are connected respectively to two ends of the insulator threads 47 to retain the insulator threads 47 in the container. Since the amount of fluorescent material (43C) on the light emitting member (4C) of the present embodiment is larger than that of fluorescent material (43B) on the light emitting member (4B) of the third embodiment, the intensity of visible light per unit area is greater as compared with that of the third embodiment.

Figure 6:
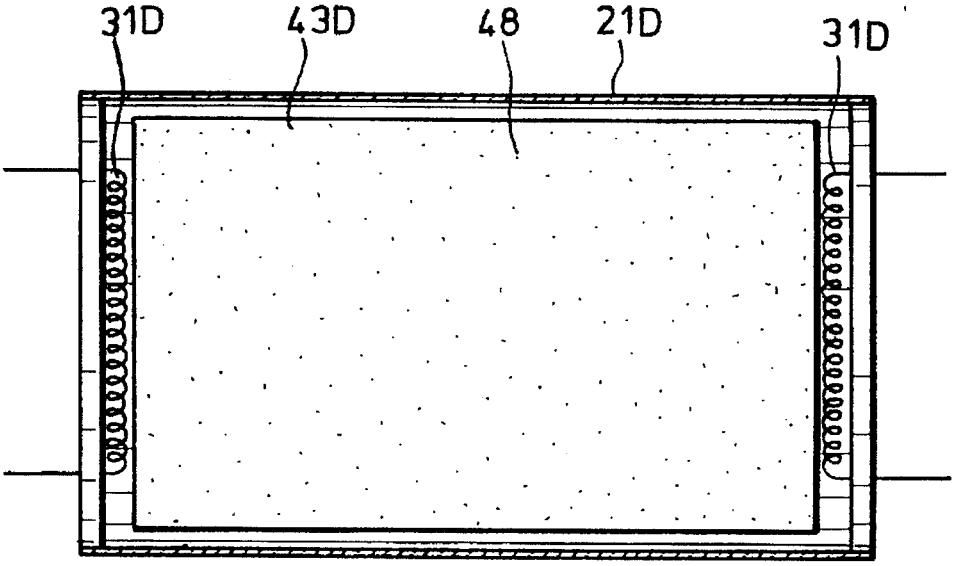
FIG. 6 is a partly sectional view of a fluorescent lamp device according to a fifth embodiment of the present invention.

Referring now to FIG. 6, a fifth embodiment of the present invention is shown. In the present embodiment, the transparent sealed container (21D) is generally rectangular in shape and has two opposed ends. The electron emitting means (31D) includes a pair of electrodes (31D) installed respectively at the two opposed ends of the container (21D). The light emitting member (4D) is a generally rectangular plate 48 having two opposed surfaces. One of the opposed surfaces is coated with a layer of fluorescent material (43D). Since the generally rectangular plate 48 serves as a planar light source, the emission of visible light is uniform and softer. Furthermore, shadows are not generated when the fifth embodiment is in use.

It should be appreciated that the light emitting member (4D) of the fifth embodiment of the present invention can be printed with a desired pattern. If such is the case, the fluorescent material on the inner peripheral surface of the container (21D) is replaced with a transparent coating which offers protection against the ultraviolet energy. Therefore, when the fluorescent lamp device is energized, the pattern on the light emitting member (4D) can be seen.

While the present invention has been described in connection with what is considered the most practical and preferred embodiments, it is understood that this invention is not limited to the disclosed embodiments, but is intended to cover various arrangements included within the spirit and scope of the broadest interpretation so as to encompass all such modifications and equivalent arrangements.

I claim:

1. A fluorescent lamp device, comprising:

a transparent sealed container filled with a working gas, said transparent sealed container is an elongated cylindrical tube having two opposed ends;

electron emitting means extending into said container and being operable to emit electrons which interact with said working gas to generate short-wave ultraviolet energy, said electron emitting means including a pair of electrodes installed respectively at said two opposed ends of said container; and a light emitting member disposed in said container and made of an insulator material, said light emitting member having an external surface coated with a layer of fluorescent material that converts the ultraviolet energy into visible light, wherein said light emitting member is an elongated member extending between said electrodes of said electron emitting means, wherein said elongated member is a rod having a plurality of insulator threads wound thereon, said rod and said insulator threads being coated with a layer of fluorescent material.

2. A fluorescent lamp device, comprising:

a transparent sealed container filled with a working gas, said transparent sealed container is an elongated cylindrical tube having two opposed ends;

electron emitting means extending into said container and being operable to emit electrons which interact with said working gas to generate short-wave ultraviolet energy, said electron emitting means including a pair of electrodes installed respectively at said two opposed ends of said container; and a light emitting member disposed in said container and made of an insulator material, said light emitting member having an external surface coated with a layer of fluorescent material that converts the ultraviolet energy into visible light, wherein said light emitting member extends between said electrodes of said electron emitting means and comprises a plurality of coiled insulator threads which are coated with a layer of fluorescent material, said light emitting member further comprising perforated members which are disposed in said container and which are connected respectively to two ends of said insulator threads for retaining said insulator threads in said container.

* * * * *